United States Patent [19]

Barry

[11] 3,983,602

[45] Oct. 5, 1976

[54] IMPLEMENT HOLDER FOR A SAFETY HELMET

[76] Inventor: Robert L. Barry, 2916 E. Randolph Road, Silver Spring, Md. 20901

[22] Filed: June 11, 1975

[21] Appl. No.: 585,830

[52] U.S. Cl. ..... 24/11 R; 24/3 R; 24/81 CC; 224/5 R

[51] Int. Cl.[2] ..... B43K 25/00; A44B 21/00

[58] Field of Search ..... 24/10, 81 T, 81 CC, 24/81 PA, 81 TA, 81 VBA, 11 PP, 11 EE, 11 CT, 11 HC, 3 R, 81 PH; 224/5 T; 268/74 A

[56] References Cited

UNITED STATES PATENTS

| | | | |
|---|---|---|---|
| 637,889 | 11/1899 | Parker | 24/11 PP |
| 3,113,363 | 12/1963 | Fyvie | 24/257 R |
| 3,228,640 | 1/1966 | Wolsh | 248/74 A |
| 3,284,844 | 11/1966 | Seckerson | 248/229 |
| 3,300,168 | 1/1967 | Gaudino | 24/81 PH |
| 3,346,153 | 10/1967 | Galasso | 24/3 R |
| 3,430,904 | 3/1969 | Soltysik | 248/74 A |
| 3,521,332 | 7/1970 | Kramer | 24/81 CC |
| 3,564,668 | 2/1971 | Kirk | 24/81 PH |
| 3,684,223 | 8/1972 | Logsdon | 24/257 R |
| 3,836,100 | 9/1974 | Gray | 248/229 |
| 3,861,701 | 1/1975 | Aring et al. | 24/81 SK |

FOREIGN PATENTS OR APPLICATIONS

| | | | |
|---|---|---|---|
| 776,393 | 1/1968 | Canada | 24/257 R |

*Primary Examiner*—Bernard A. Gelak
*Attorney, Agent, or Firm*—John N. Randolph

[57] ABSTRACT

A one piece holder preferably formed of a molded plastic having a first clamp for releasably engaging an edge portion of a safety helmet to detachably mount the holder thereon, and a second clamp projecting outwardly from one jaw of said first clamp for detachably receiving and holding a long slender object such as a pencil or pen.

4 Claims, 4 Drawing Figures

IMPLEMENT HOLDER FOR A SAFETY HELMET

SUMMARY

It is a primary object of the present invention to provide a holder which may be quickly and easily applied to or removed from a safety helmet and which will function effectively, when applied, to detachably mount a long slender implement such as a pencil or pen, so that the implement will be readily accessible to the workman wearing the helmet.

Another object of the invention is to provide such a holder which is provided with means to effectively grip a smooth hard surface of the helmet as well as the writing implement to prevent the holder from being inadvertently detached from the helmet or the writing implement being inadvertently detached from the holder.

Still another object of the invention is to provide a holder which may be very economically manufactured and sold, and which will be very durable and effective in accomplishing its intended result.

Various other objects and advantages of the invention will hereinafter become more fully apparent from the following description of the drawing, illustrating a presently preferred embodiment thereof, and wherein:

DESCRIPTION OF THE PREFERRED EMBODIMENT

Figure 1:
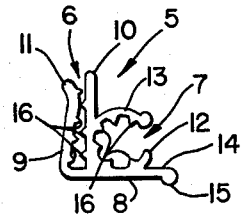
FIG. 1 is an end elevational view of the holder, looking from left to right of FIG. 2.
Figure 2:
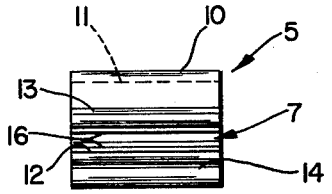
FIG. 2 is a side elevational view thereof, looking from right to left of FIG. 1.
Figure 3:
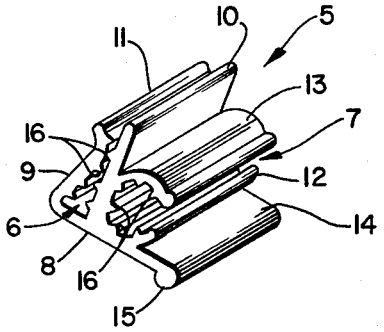
FIG. 3 is a perspective view of the holder.

Referring more specifically to the drawing, the implement holder in its entirety and comprising the invention is designated generally 5 and is preferably formed in one piece of molded plastic and includes a first clamp 6 and a second clamp 7 both of which extend from end to end of the holder.

The holder includes a relatively wide bottom portion 8 which likewise extends from end to end thereof and which forms a part of each clamp. The first clamp 6 includes a jaw 9 which constitutes an upturned extension of the inner longitudinal edge of the bottom 8. The other jaw 10 of the clamp 6 extends upwardly from the upper side of the bottom 8 and is disposed substantially perpendicular thereto, and in close proximity to the jaw 9. The jaw 9 is inclined inwardlly toward the jaw 10 and has an outwardly flared upper edge portion 11.

The clamp 7, as seen in end elevation in FIG. 1, constitutes substantially a segment of a circle and has an inner portion formed in part by a portion of the upper side of the bottom 8 and in part by a portion of an outer side of the jaw 10. A lip portion which extends upwardly from a part of the upper surface of the bottom 8 constitutes a lower jaw 12 of the clamp 7. An upper jaw 13 of the clamp 7 projects from the outer side of the jaw 10, substantially midway of its top and bottom. Both jaws 12 and 13, like the jaws 9 and 10, extend from end to end of the holder 5. The bottom 8 extends outwardly beyond the lower jaw 12 to provide a lip 14 having a bead 15 on its underside and at its outer edge.

The jaws of both clamps 6 and 7 and the portion to the clamp 7 formed by parts of the bottom 8 and jaw 10 are provided with substantially parallel ribs or serrations 16, each of which extends from end to end thereof and each of which is outwardly tapered or substantially V-shape in cross section.

The underside of the bottom 8 provides a large substantially flat surface against which the thumb can be placed for forcing the jaw 9 away from the jaw 8 as the open top or mouth of the clamp 6 is forcibly pressed against a marginal edge portion of a conventional safety helmet 17, for opening the clamp 6 to enable it to embrace an edge portion of the helmet 17.

Figure 4:
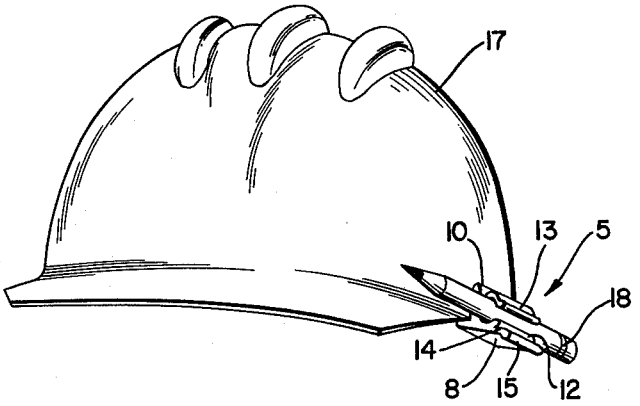
FIG. 4 is a perspective view thereof, on a reduced scale, showing the holder applied to a safety helmet and supporting a pencil.

As seen in FIG. 4, the jaw 10 is disposed on the outer side of the helmet 17 and the jaw 9 on the inner side thereof, and said jaws yieldably embrace a part of the helmet 17 up to the entire depth of said clamp. The teeth or ribs 16 of the clamp 6 yieldably grip both sides of the helmet 17 and crosswise of a downward direction by which the holder 5 can be detached from the helmet 17, to effectively retain said holder in its applied position of FIG. 4.

The lip 14 can be forced downwardly as a writing implement, such as the pencil 18, is inserted between the adjacent edges of the jaws 12 and 13, for moving the jaw 12 with said lip 14, away from the jaw 13. The teeth 16 of the clamp 7 frictionally grip the implement 18 with sufficient force so as to prevent it from sliding lengthwise from the holder. However, the lip 14 can be pressed downwardly for spreading the jaws 12 and 13 sufficiently so that the pencil 18 can be readily sprung outwardly from between said jaws or slid longitudinally from the clamp 7. The pencil 18 may also be applied by longitudinal movement into the clamp 7 while a downward pressure is being exerted on the lip 14.

Various modifications and changes are contemplated and may be resorted to, without departing from the function or scope of the invention.

I claim as my invention:

1. An implement holder for a safety helmet comprising a one piece elongated molded structure having a first upwardly opening clamp adapted to yieldably embrace a marginal portion of a safety helmet for detachably mounting the holder thereon, said clamp having an inner jaw and an outer jaw extending upwardly from a bottom, and a second outwardly opening resilient clamp projecting outwardly from said outer jaw and adapted to detachably receive and hold a long slender implement such as a pen or pencil, said clamps each extending from end to end of the holder, said bottom including a bottom portion extending outwardly, said second clamp having a lower jaw projecting upwardly from said bottom portion, said bottom portion having an outer part extending outwardly beyond said lower jaw thereby defining a lip for opening the second clamp.

2. A holder as in claim 1, said inner jaw being spring biased toward the outer jaw, and a portion of said outer jaw forming a part of said second clamp.

3. A holder as in claim 1, said clamps having inner gripping surfaces provided with ribs extending from end to end thereof.

4. A holder as in claim 1, said jaws of the first clamp being normally disposed nearly parallel to one another, and said jaws of the second clamp being arcuately bowed and having concave inner faces.

* * * * *